US007740447B2

(12) United States Patent
Pessin et al.

(10) Patent No.: US 7,740,447 B2
(45) Date of Patent: Jun. 22, 2010

(54) CENTRIFUGAL PUMP FOR ABRASIVE FLUID

(75) Inventors: Jean-Louis Pessin, Houston, TX (US); Josh Rayner, Houston, TX (US); Laurent Coquilleau, Houston, TX (US); Michael Woodmansee, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 834 days.

(21) Appl. No.: 11/621,753

(22) Filed: Jan. 10, 2007

(65) Prior Publication Data

US 2008/0166218 A1 Jul. 10, 2008

(51) Int. Cl.
*F04D 29/42* (2006.01)

(52) U.S. Cl. ..... 415/206; 415/232; 417/900

(58) Field of Classification Search ..... 415/225, 415/232, 900, 224; 417/900
See application file for complete search history.

(56) References Cited

U.S. PATENT DOCUMENTS

| | | | | |
|---|---|---|---|---|
| 3,186,352 | A | 6/1965 | Anderson | |
| 3,936,221 | A | 2/1976 | Lobanoff | |
| 4,065,232 | A | 12/1977 | Stratienko | |
| 4,224,008 | A | 9/1980 | Haentjens | |
| 4,620,804 | A | 11/1986 | Goyne | |
| 4,655,684 | A | 4/1987 | Haentjens | |
| 4,936,759 | A * | 6/1990 | Clausen et al. | 417/423.15 |
| 5,246,336 | A * | 9/1993 | Furukawa | 417/423.14 |
| 5,624,058 | A * | 4/1997 | Bailey | 417/900 |
| 5,745,575 | A * | 4/1998 | Otto et al. | 380/270 |
| 6,187,096 | B1 * | 2/2001 | Thut | 417/423.15 |
| 6,854,957 | B2 | 2/2005 | Shi | |

FOREIGN PATENT DOCUMENTS

| | | |
|---|---|---|
| DE | 2443794 | 3/1976 |
| DE | 2714455 | 10/1978 |
| DE | 20019988 | 2/2001 |
| FR | 1295588 | 6/1962 |
| FR | 2217992 | 9/1974 |

* cited by examiner

*Primary Examiner*—Richard Edgar
(74) *Attorney, Agent, or Firm*—Michael Flynn; David Cate; Robin Nava

(57) ABSTRACT

A centrifugal pump for abrasive fluid. The pump may include a bearing housing mounted to a tank containing an abrasive fluid. The bearing housing may house wear-susceptible components in a manner distancing and isolating the components from the fluid. A shaft may be coupled to the bearing housing and disposed through the tank to an impeller for dispensing the abrasive fluid beyond the centrifugal pump. Additionally the impeller itself may be housed within an impeller housing that is mechanically coupled to the bearing housing in order to enhance dimensional stability therebetween. Such a centrifugal pump may be coupled to other pumps such as higher pressure positive displacement pumps. In these circumstances the centrifugal pump may be used to facilitate the mixing of the abrasive fluid and provide a degree of pressurization thereto in advance of the fluid's use at an operation site. For example, where the fluid is a cement slurry, a triplex pump may be coupled to such a centrifugal pump for use in a cementing application at an oilfield.

17 Claims, 6 Drawing Sheets

CENTRIFUGAL PUMP FOR ABRASIVE FLUID

FIELD OF THE INVENTION

Embodiments described relate to centrifugal pumps with components that are susceptible to degradation by an abrasive fluid being pumped therefrom. In particular, embodiments of centrifugal pumps for pumping cement slurry are described in which components susceptible to degradation or malfunction by exposure to the cement slurry are safeguarded from such exposure as a result of the pump configuration.

BACKGROUND OF THE RELATED ART

Pumping of caustic or abrasive fluids may be achieved by way of centrifugal pumps in a variety of industries. For example, a centrifugal pump may be employed in oilfield operations to deliver, mix, or otherwise maintain an abrasive fluid such as a cement slurry. This is often the case where the cement slurry is to be circulated and maintained by a centrifugal pump in advance of its delivery to a high pressure pump for a cementing application in the oilfield.

Unfortunately, the abrasive fluid may wear down bearings and other wear-sensitive of the centrifugal pump upon exposure thereto. Generally, however, the slurry is prevented from contacting the wear-sensitive parts, by the presence of one or more seals of a conformable polymer or other material provided at the interface of the shaft and the impeller housing. In this way, the cement slurry may be retained inside the impeller housing, and may be occluded from access to the bearings and other components. Unfortunately, however, configurations for centrifugal pumps employed in the oilfield industry leave the seals susceptible to degradation by the abrasive cement slurry.

In spite of the susceptibility of the seals to abrasive wear as noted above, pumping of cement slurry in the oilfield industry is generally achieved by placement of the centrifugal pump, or a substantial portion thereof in direct contact with the cement slurry to be pumped. As a result, a substantial portion of the centrifugal pump, including the above described seals, remains in contact with the slurry during an oilfield cementing application in which a centrifugal pump is employed.

Regular delivery of lubricant to the seals may be provided in order to enhance their functionality. This may also help to preserve integrity of the seals in light of the contact by the cement slurry. Regardless of the seal implementation, however, seals typically wear much more quickly than other parts of the pump. By way of comparison, seals for a centrifugal pump use are likely to become ineffective at up to about ten times the rate or more of other pump parts. Therefore, the pump remains susceptible to catastrophic failure due to seal failure and subsequent bearing failure. Such failures may lead to downtime at the oilfield, at considerable cost to the operator.

Efforts may be undertaken to avoid seal degradation. For example, in other industrial settings outside of the oilfield industry, a centrifugal pump may be configured with a housing for the bearings distanced far from the impeller housing by employing an extended shaft therebetween. In such a configuration, any seals at the interface of the impeller housing and the shaft may be eliminated. Rather, seals may be positioned at the interface of the bearing housing and the shaft in order to provide protection to the bearings therein.

Unfortunately, even for embodiments employed outside of the oilfield industry, moving the seal position up the shaft may not be enough to avoid contact with an abrasive fluid being pumped through the centrifugal pump. For example, depending on the viscosity of the fluid being pumped it is often likely that a fluid such as a cement slurry will climb the shaft at the space between the shaft and its housing. This would be a likely result when pumping an abrasive fluid such as the noted cement slurry. Thus, such embodiments may be undesirable for pumping of cement. Furthermore, the seals remain prone to degradation by such abrasive fluids, thereby leaving the bearings and ultimately the pump itself susceptible to catastrophic failure. Of even greater concern when employing such pumps may be the amount of time and expense devoted to pump maintenance and clean-out following an application, especially where the abrasive is cement.

SUMMARY

A centrifugal pump for an abrasive fluid is provided with a bearing housing having a shaft coupled thereto. The shaft is disposed through a tank, which contains a fluid that may be abrasive. An impeller housing is provided that is in fluid communication with the tank which houses an impeller. The impeller housing is coupled to the bearing housing by way of a support structure that is open to the tank for easy cleaning.

DETAILED DESCRIPTION

Embodiments are described with reference to certain centrifugal pumps for pumping a cement slurry. However, a variety of centrifugal pumps may be employed for pumping a host of abrasive fluids. For example, embodiments described herein may be particularly beneficial for pumping any number of abrasive slurries through a centrifugal pump having degradable pump components. As used further herein, the term "degradable" is employed with reference to certain pump components, such as bearings, seals, and others, that are particularly susceptible to a substantially higher rate of degradation than other pump parts upon abrasive fluid exposure. Regardless, embodiments described herein include a bearing housing for containing and isolating degradable pump components away from the abrasive fluid to be pumped. As detailed below, this is achieved by running an elongated shaft from a bearing housing, through a tank of the abrasive fluid, and terminating in an impeller housing for pumping of the fluid.

Figure 1:
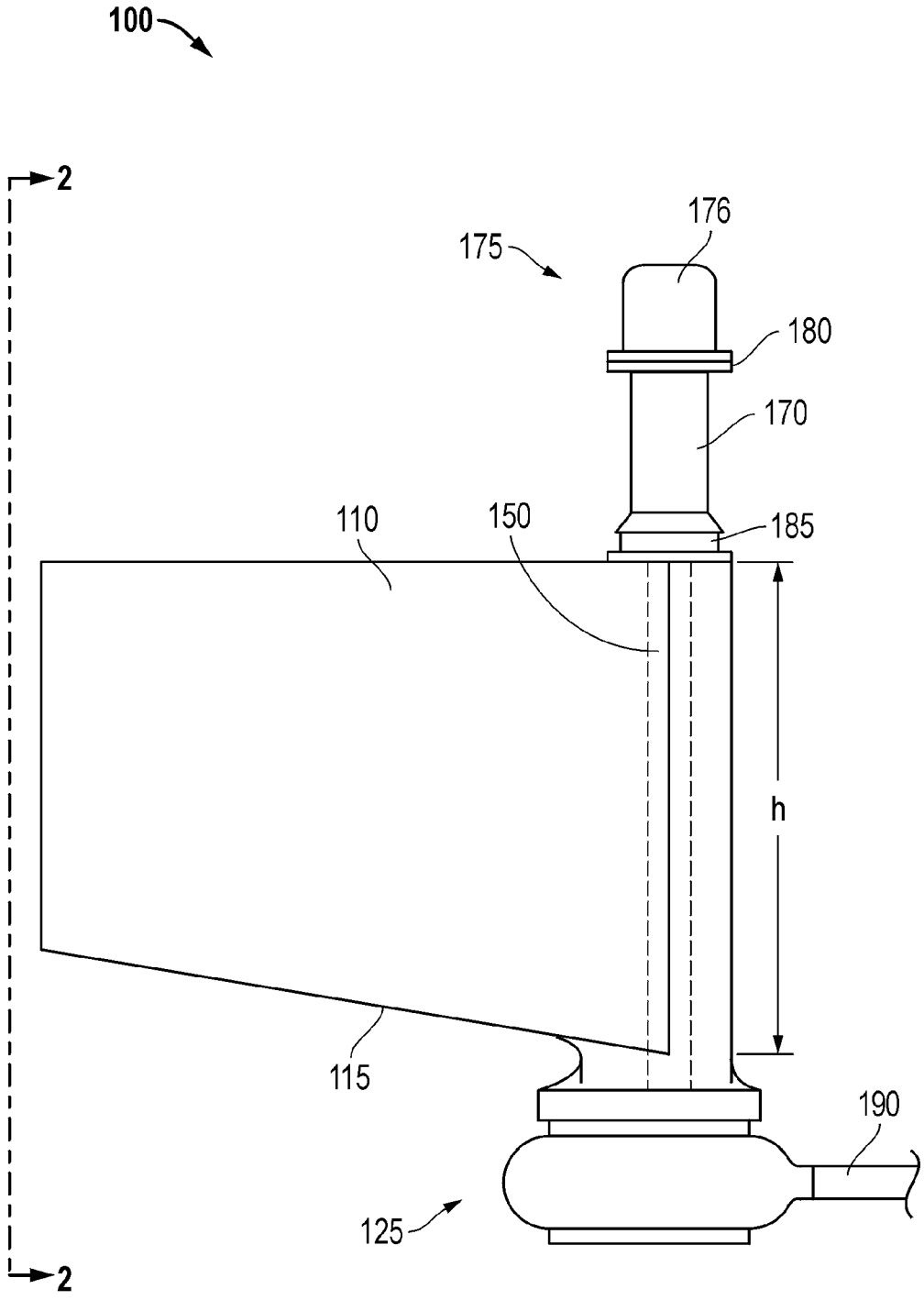
FIG. 1 is a side view of an embodiment of a centrifugal pump for abrasive fluid.

Referring now to FIG. 1, an embodiment of a centrifugal pump 100 is shown. The centrifugal pump 100 is particularly adept at accommodating an abrasive fluid while minimizing the fluid's access to certain degradable components of the pump 100 as indicated. This is achieved by locating a bearing housing 175, with the degradable components disposed therein, atop a fluid tank 110. In this manner components susceptible to degradation by the abrasive fluid (such as seals) may be substantially isolated from the fluid.

In one embodiment, the fluid tank 110 noted above is configured of stainless steel or another durable material for containing abrasive or other fluids to be pumped by the centrifugal pump 100. In the embodiments shown, the fluid tank 110 may hold as much as 25 barrels of fluid. However, other tank sizes may also be employed. Furthermore, a shaft 150 may be run from the bearing housing 175, through the fluid tank 110, and to an impeller housing 125. In one embodiment, given the distance between the housings 125, 175, the shaft 150 may be between about 3 feet and about 7 feet in length. The impeller housing 125 includes components which may be configured for pumping of the abrasive fluid. Such components may be more robust than the more degradable components that may be located at the bearing housing 175. Employing a centrifugal pump 100 of such a configuration may help to ensure that any degradable components within the bearing housing 175 are substantially isolated from contact with abrasive fluid during pumping.

Figure 2:
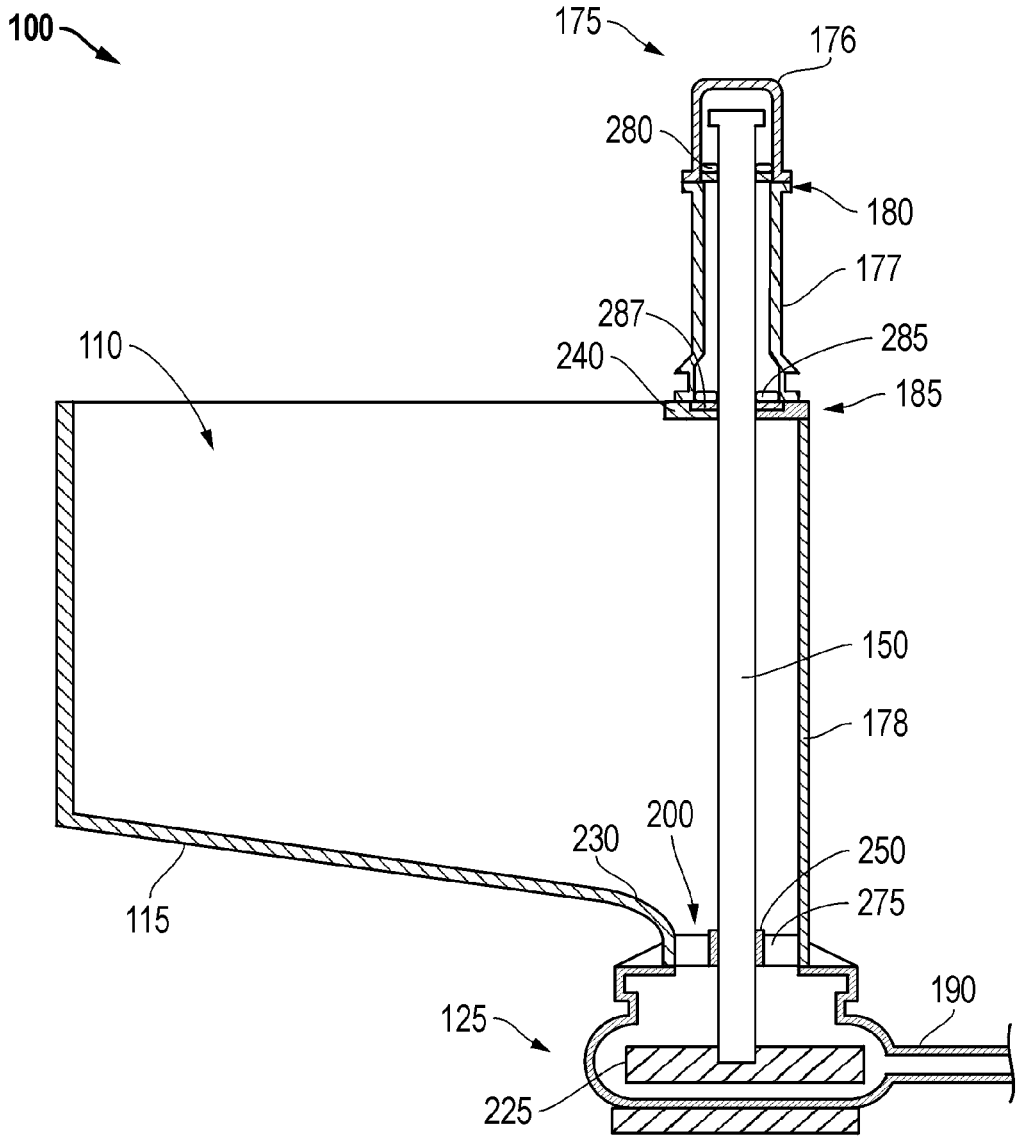
FIG. 2 is a side cross-sectional view of the centrifugal pump of FIG. 1.

Continuing with reference to FIGS. 1 and 2, components of the centrifugal pump 100 are described in greater detail. With particular examination of the bearing housing 175, seal regions 180, 185 are shown with an elongated casing 177 therebetween. The upper seal region 180 lies between a cap 176 of the housing 175 while the lower seal region 185 is adjacent the tank 110. With examination of the cross-sectional view of FIG. 2, the seal regions 180, 185 reveal bearings 280, 285 for guiding the rotation of a rotable shaft 150. A seal 287 is positioned adjacent to the bearings 285 immediately therebelow to the tank side thereof. The seal 287 may be of a conformable polymer or other such conventional material. In addition to the bearings 280, 285, other degradable driving components such as a hydraulic motor (not shown) may be in open communication with the bearing housing 175. Such a hydraulic motor may be used to power the rotation of the shaft 150 and hence an impeller 225 attached thereto. However, it should be noted that in other embodiments any appropriate power source may be coupled to the shaft 150 for powering the rotation thereof.

The positioning of the seal 287 as indicated above helps protect the bearings 280, 285 and any other degradable components disposed within the bearing housing 175. This may include protection from exposure to abrasive fluid that may be contained within the tank or other outside contamination that might affect performance. However, the entire bearing housing 175 is positioned so as to minimize the risk of exposure of the bearings 280, 285 and any other degradable components disposed within the bearing housing 175 to the abrasive fluid within the fluid tank 110 irrespective of the seal 287. That is, as shown in the embodiment of FIG. 1, the bearing housing 175 is positioned above the tank 110. In fact, in the embodiment shown, the bearing housing 175 is secured atop a lateral support 240 that is disposed at or above the height (h) of the maximum fluid level the tank 110 may contain (i.e. at the top of the tank 110). Thus, the bearing housing 175 is disposed at the highest point of the centrifugal pump 100, external to the fluid contained therein. As a result, the possibility of seal or bearing failure due to exposure to the abrasive fluid of the tank 110 is substantially eliminated.

Continuing with reference to FIGS. 1 and 2, the role of the configuration of the centrifugal pump 100 in pumping a fluid such as the above noted abrasive fluid is described in detail. As indicated above, the shaft 150 is rotable in a manner that is guided by the bearings 280, 285. As also indicated, the shaft 150 extends through the tank 110 and any abrasive fluid therein, terminating within an impeller housing 125. The impeller housing 125 includes an impeller 225 that is rotated by the shaft 150. The impeller 225 is a conventional impelling mechanism for advancing fluid from the tank 110 and out a dispensing line 190. The shaft 150, the impeller 225, and the impeller housing 125 may all be composed of stainless steel or another conventional durable material.

In one embodiment the impeller 225 may have a diameter of between about 6 inches and about 30 inches. The impeller housing intake opening (see the transition rim 230 of the drain 400 of FIG. 4) for receiving fluid from the tank 110 may be between about 4 and 12 inches in diameter and the impeller housing fluid output opening (i.e. to the dispensing line 190) may be between about 3 inches and 9 inches in diameter. In such an embodiment, the impeller 225 may be rotated at between about 1,000 rpm and about 2,100 rpm to generate between about 100 and about 300 feet of head. Additionally, up to about 45 barrels per minute of fluid may be directed to the dispensing line 190 in this manner.

The centrifugal pump 100 may also include features to encourage fluid within the tank 110 toward the impeller 225. For example, the tank 110 of the centrifugal pump 100 includes a sloped floor 115 angled toward the impeller housing 125 at up to about 30°. At its lowest point, the sloped floor 115 interfaces with a transition rim 230 to direct fluid to a drain 400 leading into the impeller housing 125 (see FIG. 4). Thus, movement of the fluid into the impeller housing 125 as described here is achieved by reliance on gravity, feeding the fluid from the tank 110 to the impeller housing 125 through the drain 400. Thus, as fluid is moved out of the impeller housing 125 and to the dispensing line 190, it may be replaced with additional fluid draining into the impeller housing 125 by way of gravity.

Continuing with reference to FIG. 2, the rotation of the shaft 150 is directed on the power end (i.e., the end containing the power source, such as a hydraulic motor) by the bearings 280, 285 as indicated. At a location opposite the bearings 280, 285, the shaft 150 traverses through a vortex breaker 200. The vortex breaker 200 may be provided in order to prevent a fluid "tornado" or swirl from forming in the tank 110. In this manner, the intake of air into the impeller housing 125 may be avoided. In the embodiment shown, the vortex breaker 200 includes a plurality of vertically oriented fins 275 to accomplish this while the fins 275 are adjoined to one another by a ring 250 adding stability thereto.

Figure 3:
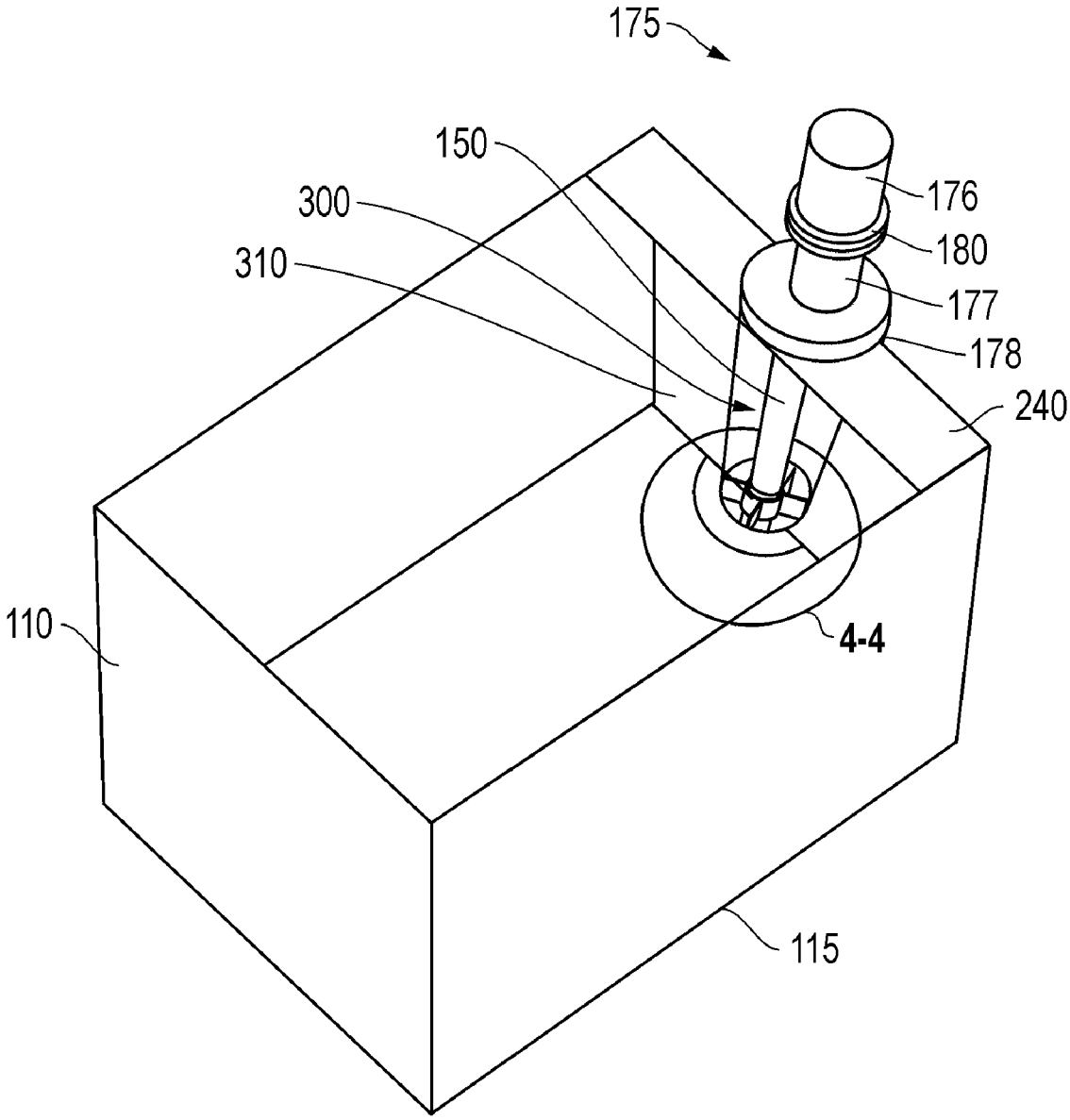
FIG. 3 is a top perspective view of the centrifugal pump of FIG. 1.

Continuing with reference to FIGS. 2 and 3, stability of the operating centrifugal pump 100 is enhanced by the fact that the housing accommodating one end of the shaft 150 (i.e. the bearing housing 175) is directly coupled to the housing that accommodates the other end of the shaft 150 (i.e. the impeller housing 125). In this way, forces that are applied to the shaft 150 emanating from the direction of the bearing housing 175 may be fully translated to the impeller housing 125. Further, the relative positions of the impeller 225 and its housing 125 are substantially maintained. From one end of the shaft 150 to the other, the surrounding structure of the pump 100 is of a unitary configuration enhancing dimensional stability throughout, including at the impeller housing 125, as the shaft 150 is rotated.

In addition to enhancing stability and balance, the coupling of the bearing housing 175 and the impeller housing 125 is achieved in such a manner as to minimize the possibility of cement build-up along the shaft. (or to maximize access for maintenance) That is, the impeller housing 125 is coupled to the bearing housing 175 by way of a partially opened passage wall 178. The passage wall 178 shown in FIG. 3 is an arcuate half-pipe structure that helps to define a passageway 300 for the shaft 150. The shaft 150 runs adjacent the passage wall 178 within the passageway 300 and between the housings 125, 175. As indicated, the passage wall 178 provides a unitary configuration to the structure surrounding the rotating shaft 150. As a result, stability and balance of the shaft 150 and housings 125, 175 relative to one another are enhanced during rotation of the shaft 150 as the pump 100 is operated. As can also be seen, the impeller housing 125 may be mounted externally to the tank at a position below the tank. This allows for the gravity feeding of the tank fluid into the impeller housing 125, minimizing the head loss associated with suction pipe length. Additionally, as described further below with reference to the passage wall 178, positioning of the impeller housing 125 in this manner minimizes the surface area of pump parts in contact with the fluid. Thus, build-up of fluid particulate may be avoided and clean-out of the pump 100 more easily achieved.

Figure 4:
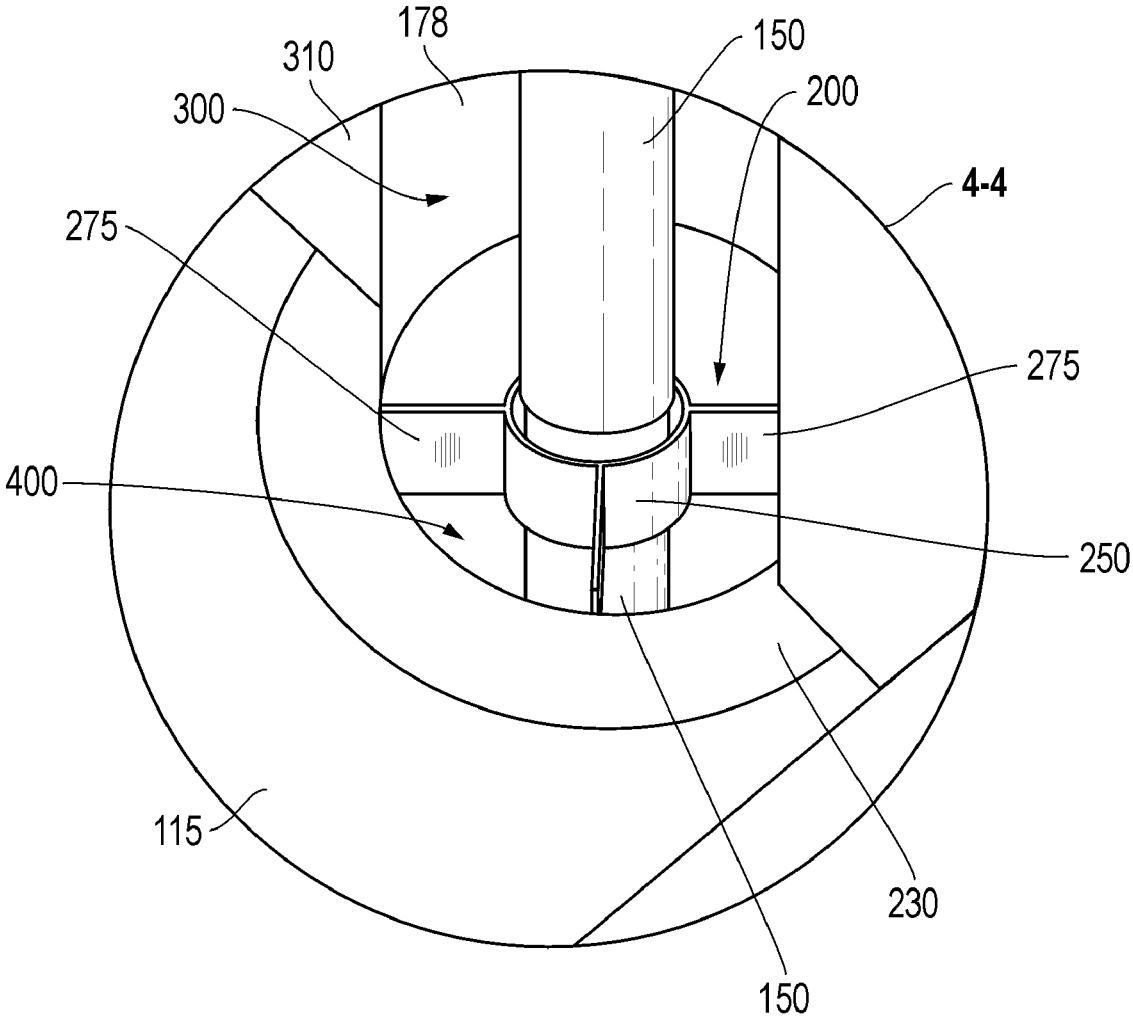
FIG. 4 is an enlarged view of a portion of the centrifugal pump taken from detail 4 of FIG. 3.

Continuing with reference to FIGS. 3 and 4, top perspective views revealing detail of the passageway 300 and drain 400 are shown. It is particularly apparent from these views that the passageway 300 and passage wall 178 are vertically built into the rear wall 310 of fluid tank 110. In this way, the passage wall 178 may be structurally reinforced by the rear wall 310. Thus, the passage wall 178 may be of a half-pipe configuration as shown while also providing ample stability as a coupling between the housings 125, 175 as detailed above.

Additionally, by employing a passage wall 178 that is of a partially open or half-pipe configuration as shown, the likelihood of a viscous fluid such as cement climbing up the shaft 150 during rotation is minimized. That is, regardless of the viscosity of the fluid being pumped, the passage wall 178 fails to encompass the shaft 150 completely, thus making it unlikely for the fluid to be able to climb up the passageway 300 toward the bearing housing 175 where more degradable pump components may be located. Thus, exposure of the degradable components of the bearing housing 175, such as the seal 287 and the bearings 280, 285, to the cement slurry is minimized or eliminated. As indicated above, employing the open passage wall 178 in this manner also minimizes particulate build-up by minimizing the surface area of pump parts in contact with the fluid (i.e. as opposed to an all-encompassing shaft housing). Furthermore, employing a partially open or half-pipe passageway 300 as shown increases access to the passage wall 178 for cleaning following a pumping application. Therefore, the passage wall 178 may be easily cleaned during cleaning of the tank 110 without significant additional effort.

In an alternative embodiment, the open passageway 300 is provided by a plurality of vertical spokes to provide coupling between the housings 125, 175 as opposed to a half-pipe passage wall 178 at the rear wall of the tank 110. In such an embodiment the passageway 300 may be provided at a variety of locations through the tank 110 not limited to the rear wall 310. Regardless, the coupling feature between the housings 125, 175 remains a structure longitudinally open to the tank 110 so as to prevent the tank fluid from climbing up the passageway 300 toward the bearing housing 175, as well as to facilitate cleaning of the shaft 150 out after use.

Referring now to FIG. 4 specifically, an enlarged view of an area surrounding the drain 400 is shown taken from detail 4 of FIG. 3. From this view the incline toward the drain 400 by the sloped floor 115 and the transition rim 230 of the tank 110 are readily apparent. Similarly, the arcuate nature of the passage wall 178 traveling around the shaft 150 and defining the passageway 300 may be seen in greater detail. Lastly, detailed features of the above described vortex breaker 200 are shown. The vortex breaker 200 includes a ring 250 and fins 275 as described above. In addition to preventing swirl of abrasive fluids, these features avoid occlusive interaction with such a fluid. For example, the slim and flat configuration of the fins 275 in particular reveal how even a relatively viscous fluid such as a cement slurry would be able to evacuate the tank 110 through the drain 400 without being significantly occluded by the presence of the fins 275.

Figure 5:
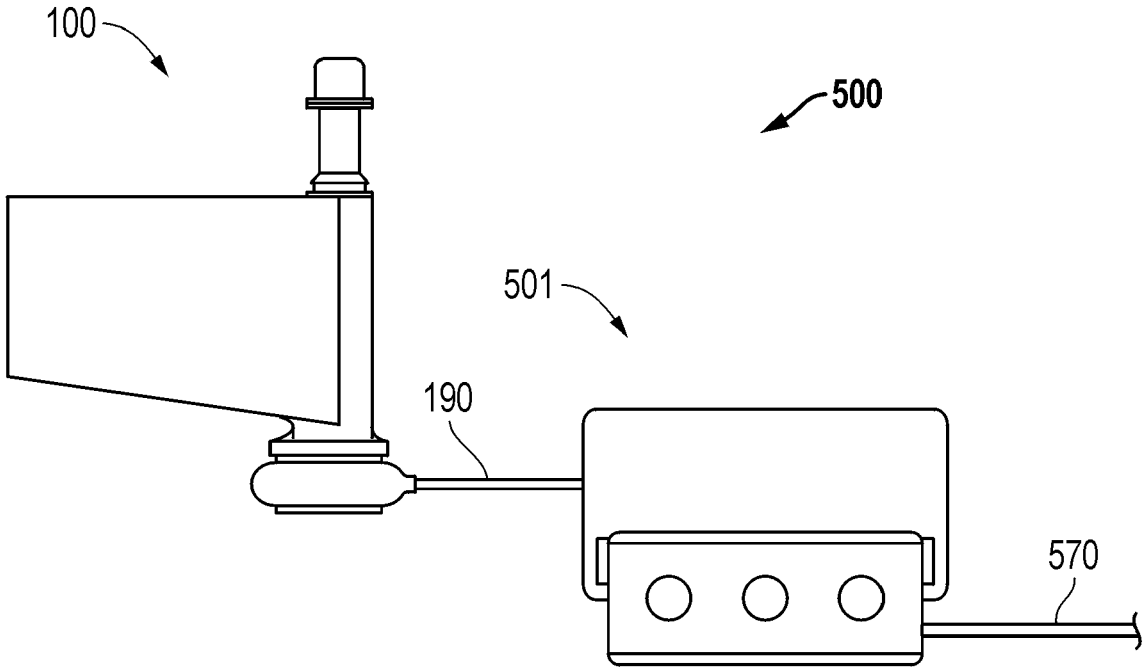
FIG. 5 is a side view of a pump assembly employing the centrifugal pump of FIG. 1.

Referring now to FIG. 5, the centrifugal pump 100 of FIGS. 1-4 is shown incorporated into a larger pump assembly 500. In the embodiment shown, the centrifugal pump 100 delivers an abrasive fluid such as cement to a positive displacement pump 501 for operations at an oilfield. In such an embodiment the centrifugal pump 100 may be employed to provide mixing and a degree of pressurization to the cement slurry in advance of its delivery to the positive displacement pump 501 via the dispensing line 190. For example, in one embodiment, the pump 100 may dispense up to about 45 barrels per minute of cement slurry into the dispensing line 190 at up to about 300 feet of head. An output line 570 is provided to the positive displacement pump 501 for ultimately directing the cement slurry toward an application site at the oilfield. Furthermore, due to the configuration of the centrifugal pump 100 as described above, the likelihood that operations at the oilfield will be interrupted or affected by a failure of a degradable component of the pump 100 is substantially reduced.

Figure 6:
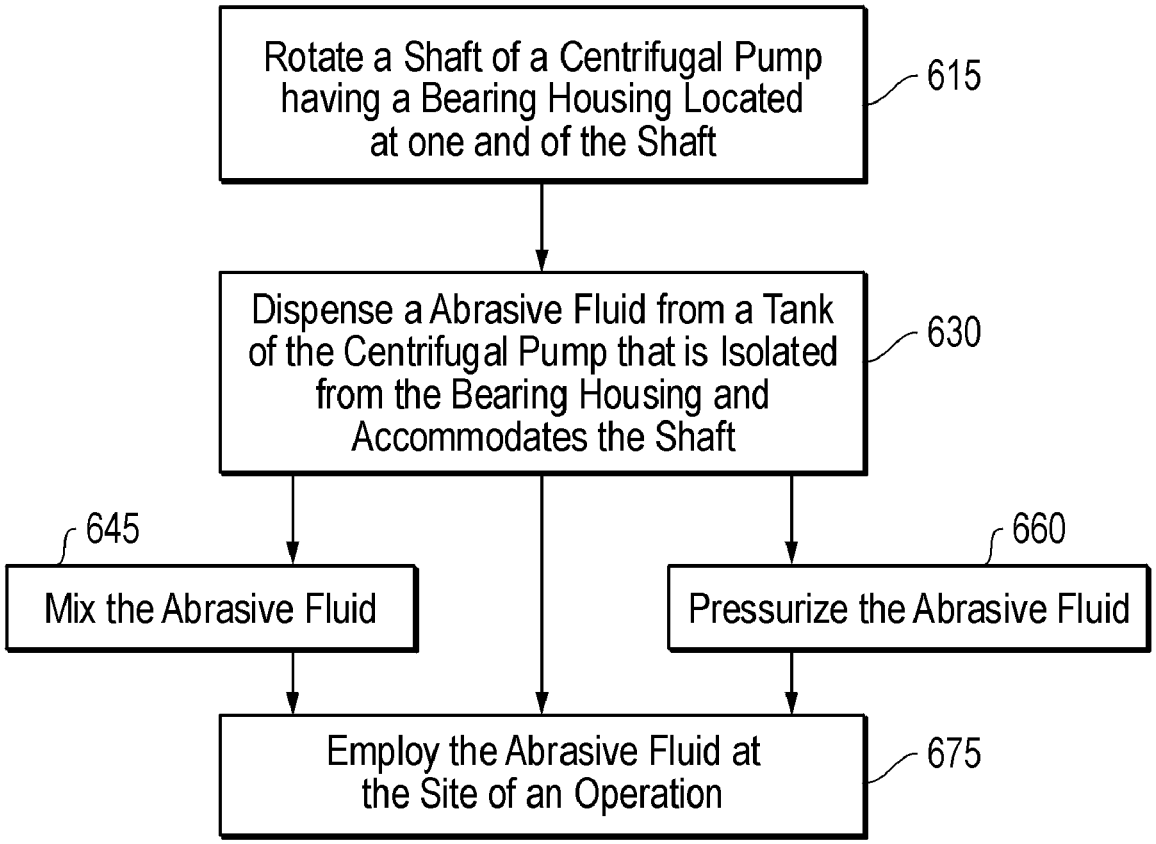
FIG. 6 is a flow chart summarizing an embodiment of employing the centrifugal pump of FIG. 1.

Referring now to FIG. 6, a method of employing an embodiment of a centrifugal pump for pumping of an abrasive fluid is summarized in the form of a flow-chart. As described above and indicated at 615, pumping by a centrifugal pump originates with the rotation of a shaft having a bearing housing located at an end thereof. Abrasive fluid may be dispensed from a tank of the centrifugal pump that is isolated away from the bearing housing and accommodates the shaft therethrough as indicated at 630. That is, as detailed above, pumping of a centrifugal pump 100 for an abrasive fluid may be initiated by the rotation of a shaft 150 that is disposed through a tank 110 accommodating the abrasive fluid while also remaining isolated from degradable components within the bearing housing 175. In this manner, the abrasive fluid may be dispensed by an impeller 225 out of the centrifugal pump 100 (see FIGS. 1-4).

Continuing with reference to FIG. 6, and as also indicated above, pumping by the centrifugal pump as described, may serve the added function of mixing or pressurizing the abrasive fluid as indicated at 645 and 660. In one embodiment the abrasive fluid is a cement slurry wherein pumping may be employed to maintain the consistency and fluidity of the slurry in advance of its ultimate use at an operation site. Similarly, it may be beneficial to provide a degree of pressurization to the slurry before it is ultimately driven to the operation site 675. For example, in one embodiment, the centrifugal pump 100 is employed as part of a larger pump assembly 500 wherein a positive displacement pump 501 receives the cement slurry from the centrifugal pump 100 and pumps it into a well bore for a cementing application at an oilfield (see FIG. 5.)

As indicated above, the embodiments described allow a centrifugal pump to pump an abrasive fluid without significant concern over the exposure of degradable pump components to the abrasive fluid. The configuration of the centrifugal pumps described is such that the concern over characteristics of components that make them susceptible to degradation or malfunction upon exposure to abrasive fluid may be eliminated. For example, the susceptibility to abrasive wear of seals, which are necessary in pumps that have seals in contact with a cement slurry, is not of significant concern in embodiments described herein due to seal isolation within a bearing housing away from the abrasive fluid. In addition, regular lubrication of the seals may not be as critical to pump life, as the likelihood of seal exposure to the abrasive fluid is greatly reduced.

In total, the configuration of centrifugal pump embodiments described provides for the extension of the life of the seals while also minimizing maintenance requirements as well as the risk of bearing failure and ultimately pump failure. These benefits may be realized in a manner that substantially avoids the possibility of the abrasive fluid climbing a shaft of the pump, hindering its rotation and ultimately affecting pump output. Furthermore, with employment of an impeller housing outside of the fluid tank and an open passage wall within the tank, the surface area of pump parts in contact with the fluid during an application is minimized. This lessens potential fluid particulate build-up and enhances clean-up following an application. In fact, the pump may be considered "self-cleaning" in as much as pumping water therethrough may be employed to substantially clean-out the pump of fluid particulate following an application.

While exemplary embodiments are described with reference to particular centrifugal pumps for pumping a cement slurry, other embodiments are possible. Additionally, many changes, modifications, and substitutions may be made without departing from the scope of the described embodiments.

We claim:

1. A centrifugal pump for an abrasive fluid, the centrifugal pump comprising:

a bearing housing;

a shaft coupled to said bearing housing;

a tank for holding the abrasive fluid, said shaft disposed through said tank;

and an impeller housing for fluid communication with said tank and housing an impeller, said impeller housing coupled to said bearing housing via a support structure which is open to said tank; and wherein said support structure defines a passage wall to accommodate said shaft, and wherein said passage wall defines an opening adjacent to the shaft to prevent the abrasive fluid from a movement along the shaft and into the bearing housing and said passage wall is of a half pipe configuration.

2. The centrifugal pump of claim 1 wherein the abrasive fluid is a cement slurry.

3. The centrifugal pump of claim 1 wherein the impeller is coupled to said shaft at a location outside of said tank.

4. The centrifugal pump of claim 1, wherein said shaft is between about 3 feet long and about 7 feet long.

5. The centrifugal pump of claim 1, further comprising a dispensing line coupled to said impeller housing, said impeller for driving the abrasive fluid into said dispensing line, said dispensing line for carrying the abrasive fluid away from the centrifugal pump.

6. The centrifugal pump of claim 1, further comprising a vortex breaker within said impeller housing and secured thereto, said vortex breaker for accommodating a portion of said shaft therethrough and for avoiding the formation of a fluid tornado within said tank.

7. The centrifugal pump of claim 1, wherein said bearing housing contains at least one degradable component which is damageable by exposure to the abrasive fluid, and wherein said bearing housing is substantially isolated from said tank to protect said at least one degradable component from exposure to the abrasive fluid.

8. The centrifugal pump of claim 7, wherein the at least one degradable component comprises one of a bearing to guide rotation of said shaft and a seal to isolate the bearing from an environment external to said bearing housing.

9. The centrifugal pump of claim 1, wherein said bearing housing is coupled to said tank via a lateral support at a top of said tank and out of contact with the abrasive fluid.

10. The centrifugal pump of claim 1, wherein said tank further comprises:

a transition rim defining a drain opening leading to said impeller housing; and a sloped floor of said tank, said sloped floor inclined toward said transition rim and coupled thereto.

11. A centrifugal pump for an abrasive fluid, the centrifugal pump comprising:

a tank for holding the abrasive fluid;

a bearing housing for accommodating a degradable component relative to the abrasive fluid and coupled to said tank;

a shaft coupled to said bearing housing and disposed through said tank; and an impeller housing in fluid communication with said tank and housing an impeller which is coupled to said shaft at a location outside of said tank, said impeller housing to dispense the abrasive fluid away from the centrifugal pump; and wherein said impeller housing is coupled to said bearing housing via a support structure which is adjacent to said shaft and open to said tank, said support structure comprises a vertically arcuate portion of a wall of said tank, said bearing housing is coupled to said tank such that the bearing housing is disposed outside of the tank, and the degradable component is one of a bearing to guide rotation of said shaft and a seal to isolate the bearing from an environment external to said bearing housing.

12. The centrifugal pump of claim 11 wherein the abrasive fluid is a cement slurry.

13. A centrifugal pump for an abrasive fluid, the centrifugal pump comprising:

a tank for holding the abrasive fluid;

a bearing housing containing a degradable component disposed externally to the tank to protect the degradable component from exposure to the abrasive fluid;

a shaft coupled to said bearing housing, said shaft disposed through said tank; an impeller housing for fluid communication with said tank and housing an impeller coupled to said shaft at a location outside of said tank; and a passage wall which couples the bearing housing to the impeller housing, and defines a passageway to accommodate said shaft, and wherein said passage wall defines an opening adjacent to the shaft to prevent the abrasive fluid from a movement along the shaft and into the bearing housing, wherein said passage wall is of a half pipe configuration.

14. The centrifugal pump of claim 13, wherein the abrasive fluid is a cement slurry.

15. The centrifugal pump of claim 13, wherein said shaft is between about 3 feet long and about 7 feet long.

16. The centrifugal pump of claim 13, wherein the degradable component comprises one of a bearing to guide rotation of said shaft and a seal to isolate the bearing from an environment external to said bearing housing.

17. The centrifugal pump of claim 13, further comprising a vortex breaker within said impeller housing and secured thereto, said vortex breaker for accommodating a portion of said shaft therethrough and for avoiding the formation of a fluid tornado within said tank.

* * * * *